US012134043B2

(12) United States Patent
Paterra

(10) Patent No.: US 12,134,043 B2
(45) Date of Patent: Nov. 5, 2024

(54) INFLATABLE PLANE ASSEMBLY

(71) Applicant: Terra Nova Media, LLC, Burbank, CA (US)

(72) Inventor: Scott Paterra, Los Angeles, CA (US)

(73) Assignee: TERRA NOVA MEDIA, LLC, Burbank, CA (US)

( * ) Notice: Subject to any disclaimer, the term of this patent is extended or adjusted under 35 U.S.C. 154(b) by 197 days.

(21) Appl. No.: 17/876,774

(22) Filed: Jul. 29, 2022

(65) Prior Publication Data

US 2023/0035376 A1 Feb. 2, 2023

Related U.S. Application Data

(60) Provisional application No. 63/226,819, filed on Jul. 29, 2021.

(51) Int. Cl.
*A63H 27/00* (2006.01)
*A63H 27/10* (2006.01)

(52) U.S. Cl.
CPC ..... *A63H 27/001* (2013.01); *A63H 27/10* (2013.01); *A63H 2027/1083* (2013.01)

(58) Field of Classification Search
CPC ..... A63H 27/00–06; A63H 2027/1066; A63H 27/001; A63H 27/10; A63H 2027/1083
See application file for complete search history.

(56) References Cited

U.S. PATENT DOCUMENTS 1,327,530 A * 1/1920 Boylston ..... A63H 27/02 446/61
1,383,115 A * 6/1921 Hendry ..... G09B 27/08 446/224
2,031,419 A * 2/1936 Kramer ..... A63H 27/001 446/232
2,476,678 A * 7/1949 Miller ..... A63H 27/10 244/33
2,505,526 A * 4/1950 Costea ..... A63H 27/06 446/187
2,664,666 A * 1/1954 Walker ..... A63H 27/005 446/61
2,683,330 A * 7/1954 Taylor ..... A63H 27/005 92/92
2,724,211 A * 11/1955 Bloom ..... A63H 27/001 446/66

(Continued)

*Primary Examiner* — Eugene L Kim
*Assistant Examiner* — Matthew B Stanczak
(74) *Attorney, Agent, or Firm* — Cohen IP Law Group, PC; Michael N. Cohen

(57) ABSTRACT

An inflatable toy plane assembly is provided. The plane assembly includes inflatable wings, an inflatable fuselage, an inflatable empennage (tail area stabilizers), and/or other inflatable elements. Not all elements of the inflatable plane assembly are required to be inflatable, e.g., the wings may be inflatable, and the fuselage may not. The plane assembly preferably includes one or more valves to facilitate the inflating and deflating of the plane's inflatable elements. In use, the inflatable plane assembly is deflated for compact storage (e.g., rolled up) and subsequently inflated when preparing the assembly for flight. The plane includes detachable wings and/or detachable tail stabilizers that are detached for storage, and subsequently reattached to the plane's fuselage and inflated for use.

10 Claims, 14 Drawing Sheets

(56) References Cited

U.S. PATENT DOCUMENTS 2,739,414 A * 3/1956 Cleveland ..... F16B 5/0614 403/170
2,763,958 A * 9/1956 Lemelson ..... A63H 27/10 446/225
2,979,287 A * 4/1961 Ross ..... B64C 3/46 244/219
3,092,359 A * 6/1963 Pohl ..... A63H 27/085 446/221
3,106,373 A * 10/1963 Bain ..... B64C 3/30 244/119
3,177,612 A * 4/1965 Giossi ..... A63H 27/004 446/64
3,218,756 A * 11/1965 Dragich ..... A63H 27/005 446/221
3,225,488 A * 12/1965 Goldfarb ..... A63H 27/10 446/224
3,229,418 A * 1/1966 Dragich ..... A63H 27/06 124/31
3,463,420 A * 8/1969 Carter ..... B64C 3/54 244/49
3,559,920 A * 2/1971 Moore ..... B64C 1/062 244/119
3,591,975 A * 7/1971 Terc ..... A63H 27/10 446/225
3,662,487 A * 5/1972 Seefluth ..... A63H 27/12 446/37
3,665,640 A * 5/1972 Kirk ..... A63H 27/06 446/187
3,690,401 A * 9/1972 Earl ..... B60V 3/08 180/128
3,744,741 A * 7/1973 Christian ..... A63H 27/001 244/49
4,003,155 A * 1/1977 Raskin ..... A63H 27/02 446/67
4,096,660 A * 6/1978 Ralph ..... A63H 27/06 446/56
4,184,681 A * 1/1980 Graham, Jr. ..... F41J 9/10 244/1 TD
4,203,250 A * 5/1980 Garofalo ..... A63H 27/001 446/61
4,228,977 A * 10/1980 Tanaka ..... A63H 27/08 43/2
4,265,418 A * 5/1981 Eymard ..... B64B 1/08 244/125
4,298,175 A * 11/1981 Earl ..... B60V 3/08 244/101
4,458,442 A * 7/1984 McDaniel ..... A63H 27/00 446/66
4,494,940 A * 1/1985 Gretz ..... A63H 27/02 446/61
5,003,722 A * 4/1991 Berkley ..... A01M 31/06 43/3
5,007,875 A * 4/1991 Dasa ..... A63H 27/001 446/68
5,115,997 A * 5/1992 Peterson ..... B64B 1/20 244/33
5,176,559 A * 1/1993 Lane ..... A63H 27/00 446/61
5,882,240 A * 3/1999 Larsen ..... A63H 27/00 446/225
6,056,616 A * 5/2000 Bushman ..... A63H 27/00 446/61
6,105,903 A * 8/2000 Chen ..... A63H 27/08 446/61
6,425,794 B1 * 7/2002 Levy ..... A63H 27/02 446/61
7,331,546 B2 * 2/2008 Ifju ..... B64U 30/12 244/123.1
8,007,337 B1 * 8/2011 DeMasi, Sr. ..... B63B 34/54 446/79
8,858,350 B2 * 10/2014 Christoffel ..... A63H 27/005 472/130
8,939,810 B1 * 1/2015 Suknanan ..... A63H 27/02 446/93
9,138,654 B2 * 9/2015 Li ..... A63H 27/02
10,807,012 B1 * 10/2020 Snider ..... A63H 27/001
11,752,443 B1 * 9/2023 Snider ..... A63H 33/18 446/225
2003/0064658 A1 * 4/2003 Zheng ..... A63H 27/005 446/220
2003/0192985 A1 * 10/2003 Lipeles ..... B64C 3/30 244/13
2003/0197090 A1 * 10/2003 Klima ..... B64D 17/00 244/4 A
2004/0248496 A1 * 12/2004 Harvey ..... B64U 30/10 446/61
2005/0009440 A1 * 1/2005 Foster ..... A63H 27/14 446/231
2005/0191930 A1 * 9/2005 Foster ..... A63H 27/10 446/57
2006/0105667 A1 * 5/2006 Smith ..... A63H 27/10 446/220
2006/0292957 A1 * 12/2006 Howard ..... A63H 27/001 446/61
2007/0161322 A1 * 7/2007 Carmon ..... A63H 27/10 446/220
2008/0014827 A1 * 1/2008 Amireh ..... A63H 27/02 446/58
2008/0090487 A1 * 4/2008 Randall ..... A63H 33/22 446/225
2008/0242186 A1 * 10/2008 Amireh ..... A63H 29/22 446/57
2008/0265053 A1 * 10/2008 Guzman ..... A61L 9/12 239/34
2009/0229163 A1 * 9/2009 Latschaw ..... A01M 31/06 43/2
2011/0117806 A1 * 5/2011 Frontera Castaner ..... A63H 27/001 446/34
2011/0130066 A1 * 6/2011 Amireh ..... A63H 29/22 446/34
2012/0018568 A1 * 1/2012 Farbolin ..... B64C 31/02 244/16
2012/0241552 A1 * 9/2012 Gentile ..... A63H 27/00 244/12.2
2013/0284853 A1 * 10/2013 Farbolin ..... B64C 31/02 244/16
2013/0310188 A1 * 11/2013 Christoffel ..... A63H 27/005 472/130
2015/0053819 A1 * 2/2015 Becklin ..... B64U 80/70 244/131
2015/0298017 A1 * 10/2015 Curley ..... A63H 27/001 446/37
2016/0257417 A1 * 9/2016 Curley ..... A63H 27/00
2019/0168872 A1 * 6/2019 Grubb ..... B64F 5/10
2020/0164280 A1 * 5/2020 Todokoro ..... A63H 27/005
2020/0172236 A1 * 6/2020 George ..... B64U 30/14
2021/0205723 A1 * 7/2021 Scholz ..... A63H 27/005
2023/0035376 A1 * 2/2023 Paterra ..... A63H 27/10
2023/0211245 A1 * 7/2023 Feng ..... A63H 30/04 244/120

* cited by examiner

INFLATABLE PLANE ASSEMBLY

CROSS-REFERENCE TO RELATED APPLICATIONS

This application claims priority to U.S. Provisional Application No. 63/226,819 filed Jul. 29, 2021, the entire contents of which are hereby fully incorporated herein by reference for all purposes.

FIELD OF THE INVENTION

This invention relates to toy airplanes, including inflatable toy airplanes.

BACKGROUND

Toy airplanes of all sizes are popular throughout the world. However, larger versions of toy airplanes are often bulky, and difficult to stow. In addition, the toy airplanes are oftentimes prone to breakage.

Accordingly, there is a need for a toy airplane with inflatable components that may be deflated for stowage and inflated for use. There also is a need for a toy airplane with inflatable components that is resistant to breakage. The presently disclosed assembly addresses these needs.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF EXEMPLARY EMBODIMENTS

In general, and according to exemplary embodiments hereof, an inflatable toy plane assembly is provided. In some embodiments, the plane assembly includes inflatable wings, an inflatable fuselage, an inflatable empennage (tail area stabilizers), and/or other inflatable elements. Not all elements of the inflatable plane assembly are required to be inflatable, e.g., in some embodiments the wings may be inflatable, and the fuselage may not. The plane assembly preferably includes one or more valves to facilitate the inflating and deflating of the plane's inflatable elements.

In use, the inflatable plane assembly may be deflated for compact storage (e.g., rolled up) and subsequently inflated when preparing the assembly for flight. In some embodiments, the plane includes detachable wings and/or detachable tail stabilizers that are detached for storage, and subsequently reattached to the plane's fuselage and inflated for use.

Figure 1:
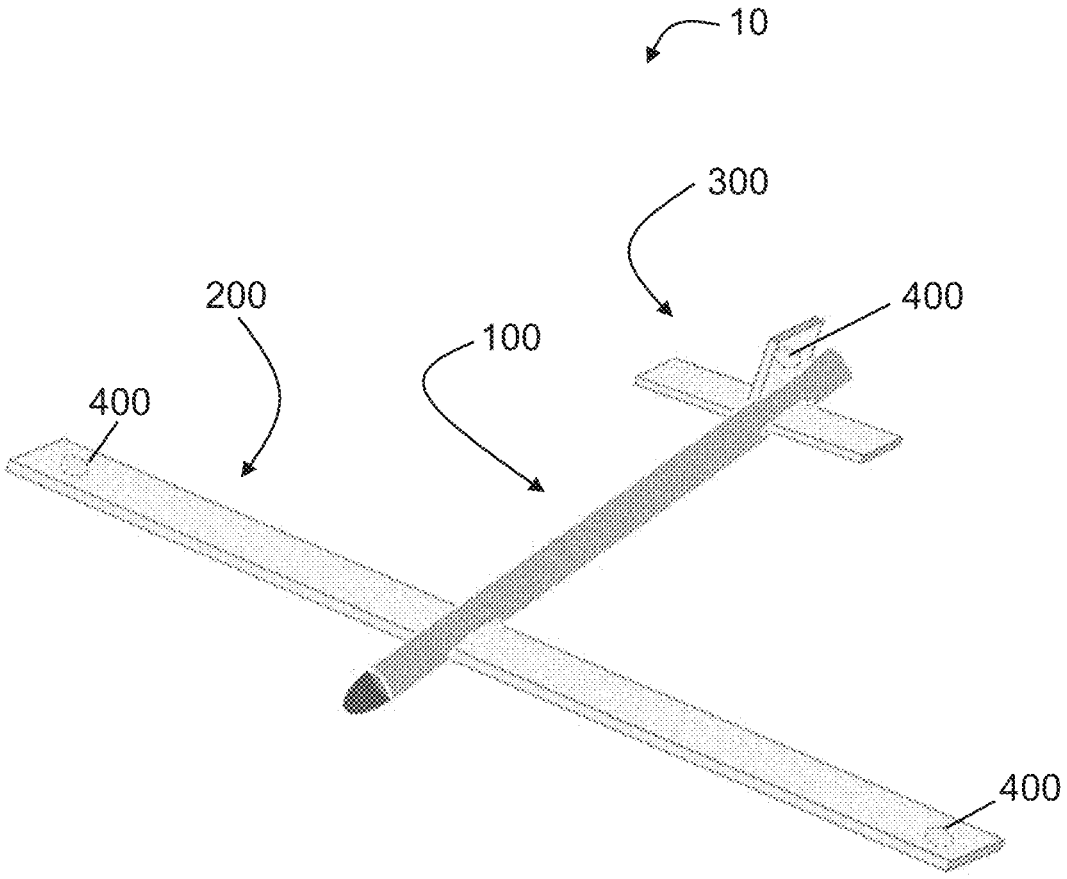
FIG. 1 shows an inflatable airplane assembly according to exemplary embodiments hereof.

In one exemplary embodiment hereof, as shown in FIG. 1, the inflatable plane assembly 10 includes a fuselage assembly 100, a wing assembly 200, and an empennage assembly 300. The assemblies 100, 200, 300 may be inflatable. The plane assembly 10 also includes one or more valve mechanisms 400 and associated mechanisms adapted to facilitate the inflating and deflating of the various inflatable elements. The inflatable plane assembly 10 also may include other elements and/or components as necessary to perform its functionalities.

Fuselage Assembly 100

Figure 2:
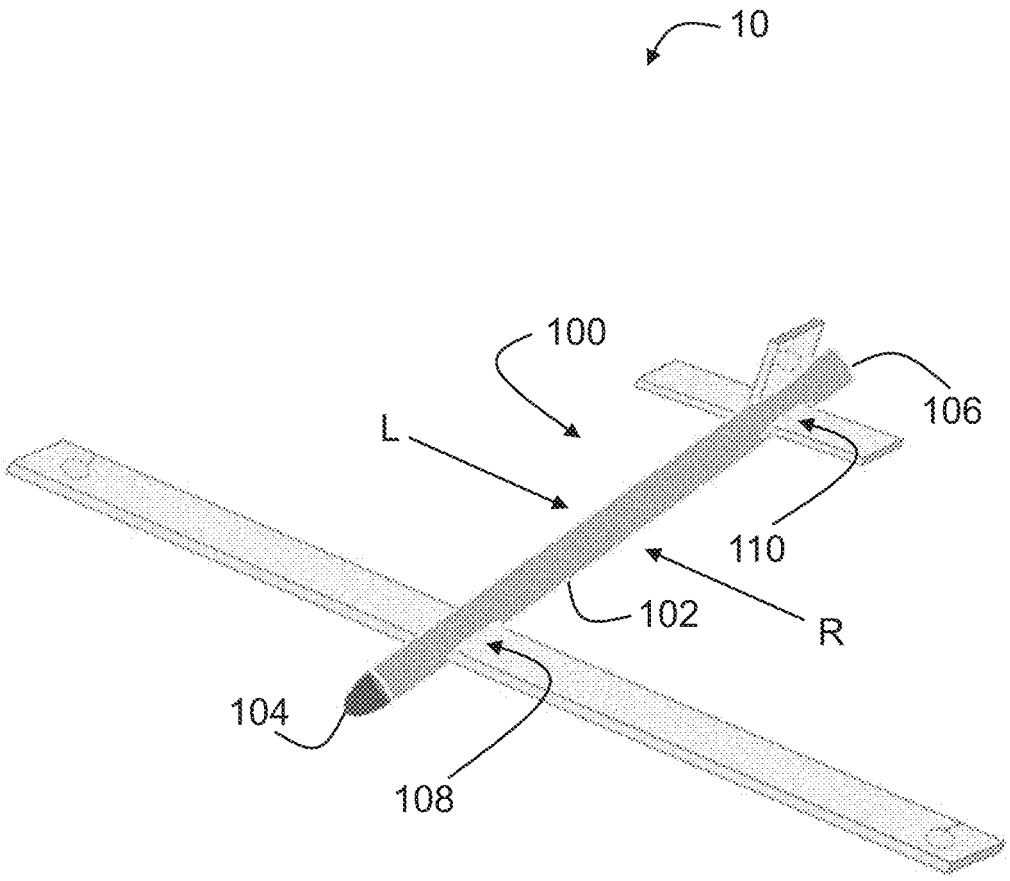
FIGS. 2-3 show a fuselage assembly according to exemplary embodiments hereof.

In some embodiments as shown in FIG. 2, the fuselage assembly 100 includes an elongate body 102 including a first end 104 (also referred to as the nose), and a second end 106 (also referred to as the tail). For the purposes of this specification, the left side L, and the right side R of the fuselage body 102 will be defined as shown in FIG. 2. The fuselage assembly 100 also includes a wing attachment mechanism 108 and an empennage attachment mechanism 110, each adapted to attach their respective corresponding assemblies 200, 300 to the fuselage 100.

In some embodiments, the fuselage body 102 comprises a single piece extending from the first end 104 to the second end 106. In other embodiments, the body 102 may comprise two or more portions that are attached together to form the body 102 (e.g., two sections that are configured longitudinally to form the elongate body 102). The body 102 may include a hollow structure (e.g., a hollow tube), a solid structure (e.g., a lightweight solid structure of rigid foam or other preferably lightweight materials such as plastic), and/or any combinations thereof. Accordingly, the inner volume of the body 102 may be hollow and/or solid. The cross-sectional shape of the body 102 is preferably circular, oval, square, rectangular, other suitable shapes, and/or any combinations thereof. It also is contemplated that the body 102 comprise a telescoping structure that may be expanded for use and retracted for storage. While a single fuselage has been described above, it also is contemplated that the fuselage assembly 100 include other types of fuselages, including but not limited to, twin fuselages, with any of the fuselages with or without a foreplane.

Figure 3:
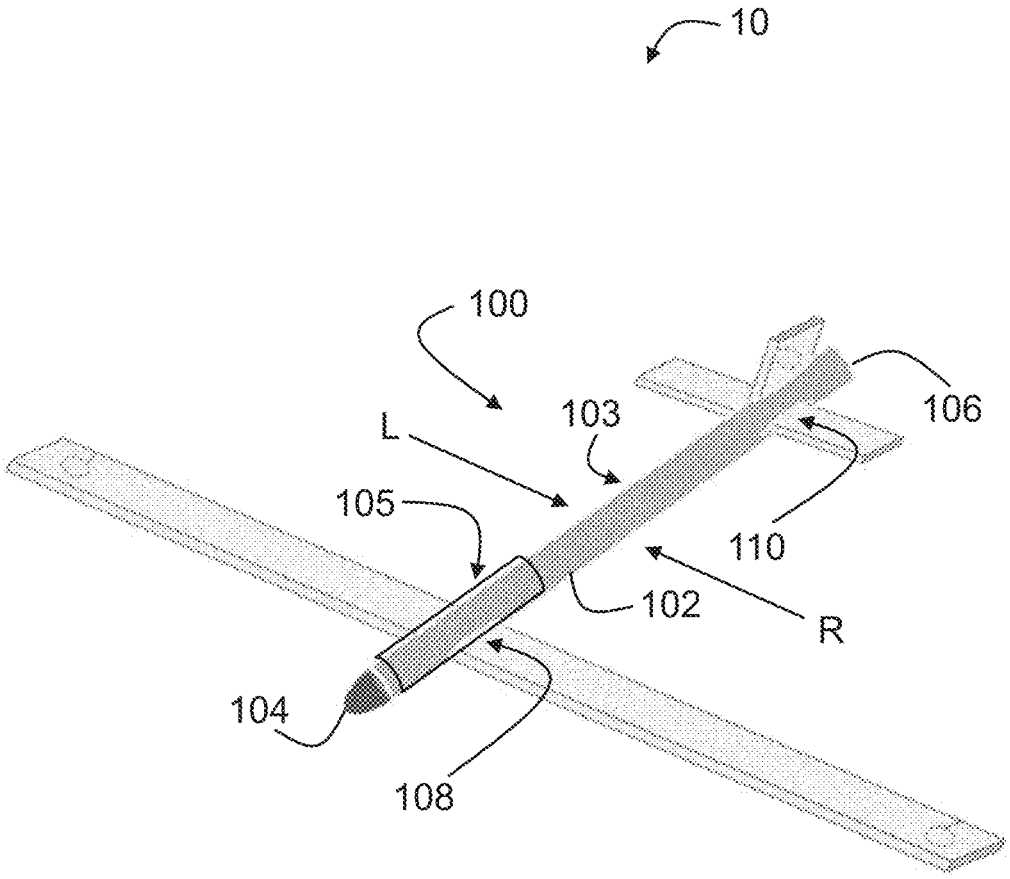

It also is contemplated that the fuselage body 102 is inflatable, including an inflatable outer shell with a generally hollow inner volume. It also is contemplated that the fuselage body 102 is partially inflatable (some portions are inflatable and others are not), and any/or combinations thereof. For example, as shown in FIG. 3, the fuselage body 102 may include an inflatable portion 103 supported by a non-inflatable portion 105. In some embodiments, the non-inflatable portion 105 may include a rigid tube through which the inflatable portion 103 may be inserted and supported thereby (e.g., especially in the areas of the wing attachment mechanism 108). The architecture of such an inflatable body 102 is described in other sections.

In addition, while the fuselage body 102 is generally depicted as a cylinder with a generally constant diameter, it is understood that the fuselage body 102 may be formed as any elongate shape or form. For example, the fuselage body 102 may include a larger diameter in the area(s) of its interface with the wing assembly 200 and/or the empennage assembly 300 to provide addition support to these areas.

In some embodiments, the first end 104 is preferably formed as an aerodynamic shape such as, without limitations, a half-sphere, a half-spheroid, a cone, a pyramid, other suitable shapes, and any combinations thereof.

Figure 4:
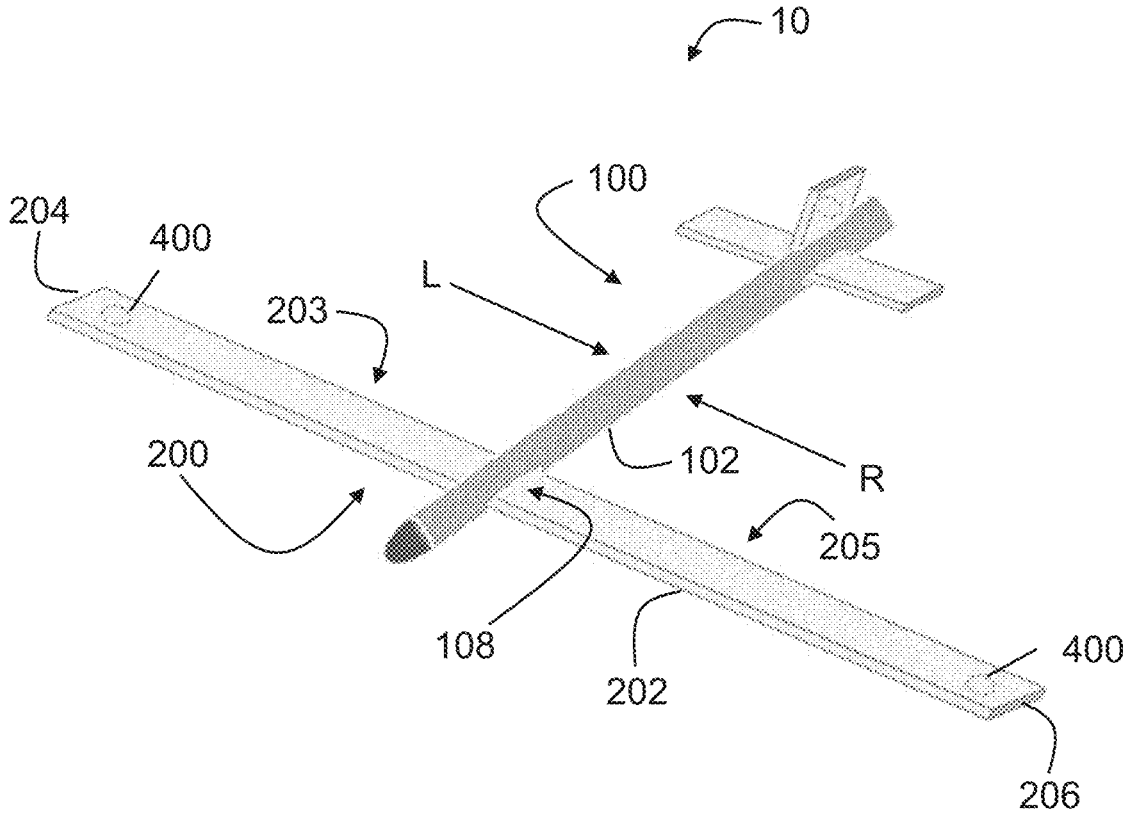
FIG. 4 shows a wing assembly according to exemplary embodiments hereof.
Figure 6:
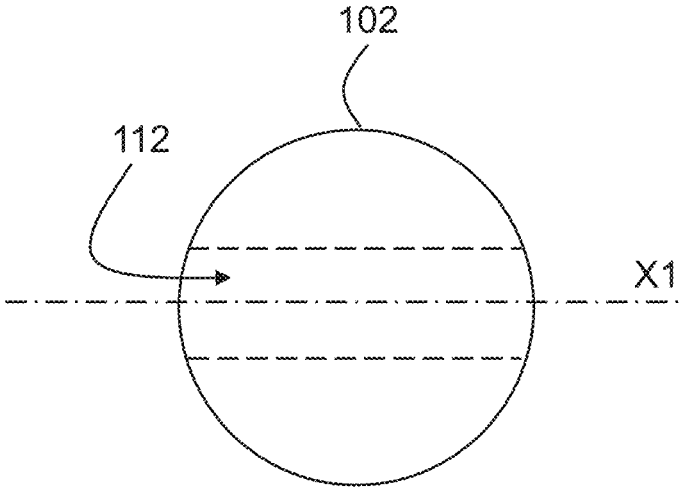

In some embodiments, as shown in FIG. 4, the fuselage assembly 100 includes a wing attachment mechanism 108 adapted to attach the wing assembly 200 to the fuselage body 102. In addition, as will be described in other sections, in some embodiments, as shown in FIG. 4, the wing assembly 200 includes a single-piece wing member 202 while in other embodiments, as shown in FIG. 6, the wing assembly 200 includes a multi-piece wing member 208. The multi-piece wing member 208 includes a separate left wing member 210 and a separate right wing member 212. Given the above, the attachment mechanism 108 is designed to accommodate a single-piece wing member 202, a multi-piece wing member 208, and/or any combinations thereof.

Because the structure of the attachment mechanism 108 may depend on whether the wing assembly 200 includes a single-piece wing member 202 or a multi-piece wing member 208, the wing assembly 200 will be described next followed by a description of the various associated attachment mechanism 108 embodiments.

Wing Assembly 200

In some embodiments as shown in FIG. 4, the wing assembly 200 includes a single-piece elongate inflatable wing member 202 including a first end 204 (e.g., the left end in FIG. 3), and a second end 206 (e.g., the right end in FIG. 3). In this embodiment, the inflatable wing body 202 extends from the first end 204 to the second end 206 continuously as a single unit.

Figure 5:
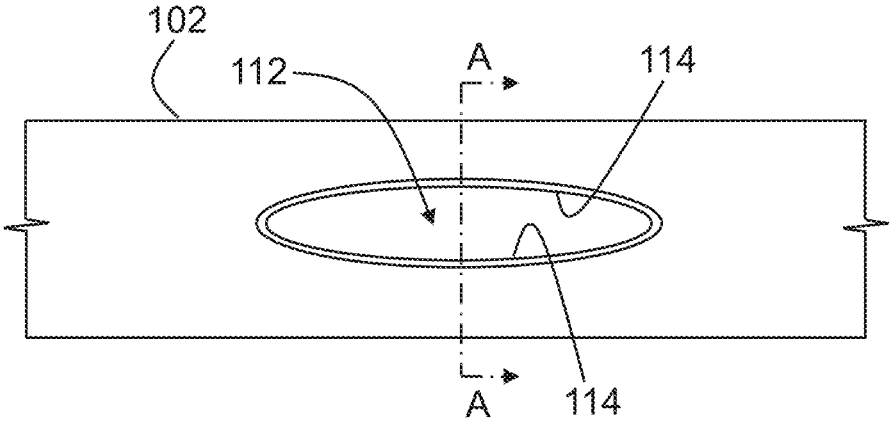
FIGS. 5-7 show aspects of attachment mechanisms according to exemplary embodiments hereof.

FIG. 5 shows the attachment mechanism 108 of FIG. 4 looking directly into the attachment mechanism 108 of FIG. 4 from the right R side. In some embodiments, as shown in FIGS. 4-5, to accommodate a single-piece wing member 202, the attachment mechanism 108 includes a through-slot 112 that passes through the fuselage's elongate body 102 from its left side L to its right side R. In this case, the single-piece wing member 202 is designed to be received through the through-slot 112 such that a first wing portion 203 (e.g., the left half) of the wing member 202 extends outward from the fuselage body 102 on the left side L and a second wing portion 205 (e.g., the right half) extends outward from the fuselage body 102 on the right side R. It may be preferable that the wing member 202 be generally centered with the longitudinal axis of the fuselage body 102 (defined by the tip end 104 and the tail end 106) so that the left and right wing portions 203, 205 include the same dimensions (i.e., the portions 203, 205 extend outward from the fuselage body 102 the same amount).

In some embodiments, as shown in FIG. 5, the through-slot 112 includes a cross-sectional shape (looking into the left or right sides) that corresponds to the cross-sectional shape of the wing member 202. In this way, the wing member 202 may fit snug within the slot 112 and be held in place therein. It is understood that while FIG. 5 shows the cross-sectional shape of the through-slot 112 as generally oval shaped for demonstration, that the cross-sectional shape of the through-slot 112 may be formed as any shape, e.g., depending on the cross-sectional shape and form of the wing member 202 at the interface between the wing member 202 and the slot 112.

As known in the art, a dihedral angle in aeronautics is the upward angle of the left and right wing portions 203, 205 with respect to the horizontal. The dihedral angle has a strong influence on the dihedral effect (the amount of roll moment produced in proportion to the amount of sideslip).

Figure 7:
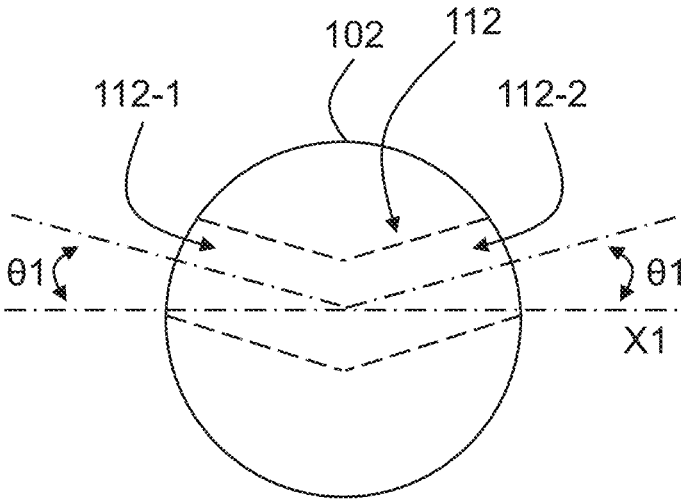

FIGS. 6-7 show cross-sectional views of the fuselage body 102 and through-slot 112 of FIG. 5 taken from the perspective of cutlines B-B for two different embodiments, respectively. As shown, in a first embodiment, the through-slot 112 of FIG. 6 passes through the fuselage body 102 generally parallel to the horizontal axis X1 such that the first and second wing portions 203, 205 extending outward on the left and right sides, respectively, also will each be generally parallel to the horizontal axis X1. In this case, the dihedral angle of the wing portions 203, 205 is generally zero.

However, in a second embodiment, the through-slot 112 of FIG. 7 includes a first portion 112-1 (e.g., on the left side of the fuselage 102) and a second portion 112-2 (e.g., on the right side of the fuselage 102) with the first and second portions 112-1, 112-2 each at upward angles θ1 with respect to the horizontal axis X1. In this way, the first wing portion 203 will be upwardly inclined at an angle of θ1 on the left side and the second wing portion 205 will be upwardly inclined at an angle of θ1 on the right side. It may be preferable that the first and second through-slot portions 112-1, 112-2 meet at a middle point within the fuselage body 102 so that the length of the portions 112-1, 112-2 are equal.

In some embodiments, as shown in FIG. 5, the through-slot 112 includes reinforcement structures 114 on its inner surfaces to provide additional support and/or rigidity to the slot 112 and the wing member 202 passing therethrough. The reinforcement structures 114 may include top, bottom, and/or side panels that extend through the slot 112 from the left L to the right R (or any portions thereof), top, bottom, and/or side beams that extend through the slot 112 from the left L to the right R (or any portions thereof), thickened top, bottom, and/or sidewalls within the slot 112, other types of reinforcement structures, and any combinations thereof. For example, the reinforcement structures 114 may include a rigid upper sidewall and/or plate at the intersection of the first and second slot portions 112-1, 112-2 within the fuselage 102.

Figure 8:
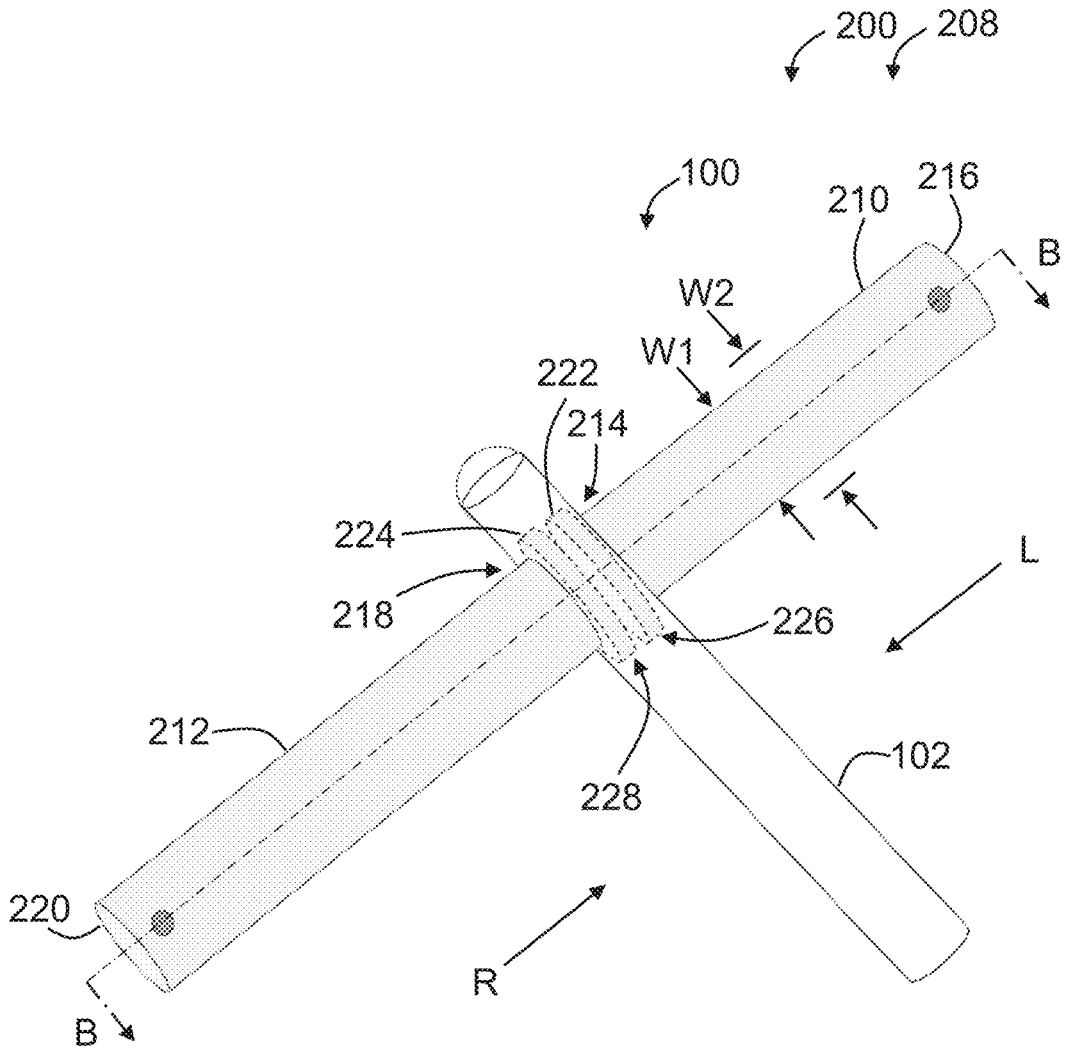
FIG. 8 shows a wing assembly according to exemplary embodiments hereof.

In other embodiments, as shown in FIG. 8, the wing assembly 200 includes a multi-piece wing member 208, including a left inflatable wing member 210 designed to be secured to the left side L of the fuselage body 102 and a right inflatable wing member 212 designed to be secured to the right side of the fuselage body 102. The left wing member 210 includes a proximal end 214 and a distal end 216, and the right wing member 212 includes a proximal end 218 and a distal end 220.

In some embodiments, the proximal end 214 of the left wing member 210 includes a left mount member 222, and the proximal end 220 of the right wing member 212 includes a right mount member 224. In some embodiments, the mount members 222, 224 include larger cross-sections than the cross-sections of the portions of the wing members 210, 212 that extend outward from the fuselage body 102 on the left and right sides, respectively. That is, the mount elements 222, 224 extend outward from the wing members 210, 212, respectively, so that the mount elements 222, 224 include a larger end footprint than the wing members 210, 212 themselves. In this way, the mount members 222, 224 may be referred to as bulbs or heads.

In some embodiments, as shown in FIG. 8, the attachment mechanism 108 includes a left inner cavity 226 extending into the fuselage body 102 on the left side L and a right inner cavity 228 extending into the fuselage body 102 on the right side R. The right and left inner cavities 226, 228 are designed to receive the left and right mounting members 222, 224, respectively.

Figure 9:
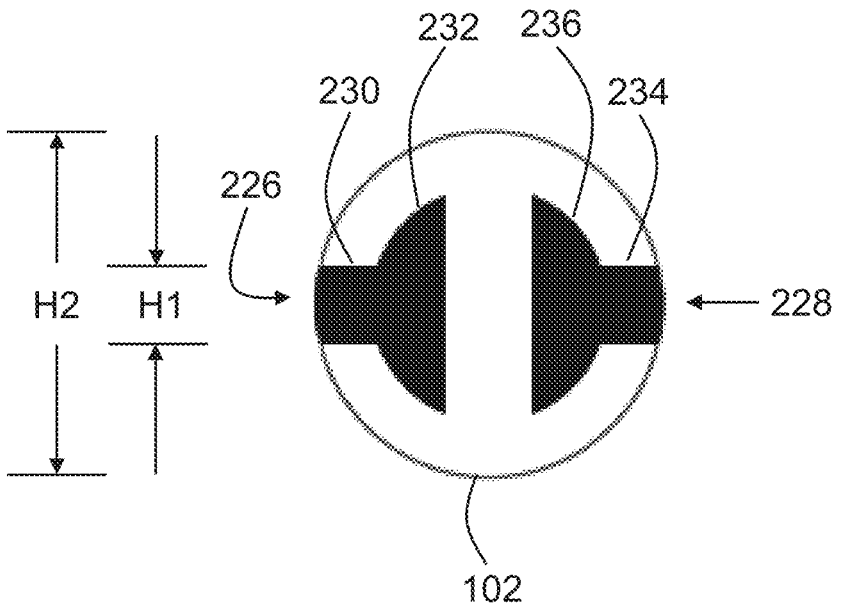
FIG. 9 shows aspects of an attachment mechanism according to exemplary embodiments hereof.
Figure 10:
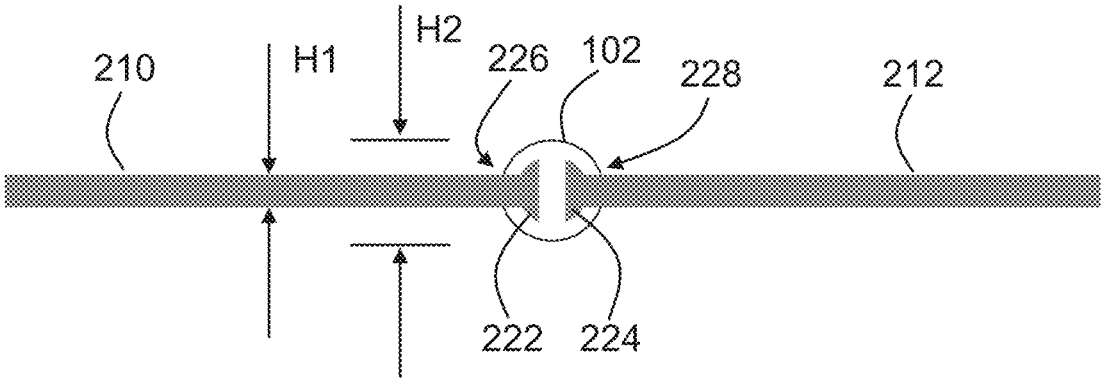
FIGS. 10 and 10A show aspects of an attachment mechanism and associated wing members according to exemplary embodiments hereof.

FIG. 9 shows the cross section of the fuselage body 102 as described above taken from the perspective of the cutlines B-B of FIG. 8 (sans the wing members 210, 212 for added clarity), and FIG. 10 shows the same and including the left and right wing members 210, 212 configured in the respective inner cavities 226, 228. As shown in FIG. 9, the left inner cavity 226 includes a left cavity entrance 230 and a left cavity inner portion 232, and the right inner cavity 228 includes a right cavity entrance 234 and a right cavity inner portion 236. In some embodiments, the left and right inner cavities 226, 228 are separate and distinct (e.g., there may be an inner barrier between the cavities 226, 228), while in other embodiments, the left and right inner cavities 226, 228 may be joined within the inner volume of the fuselage body 102 (e.g., the innermost surfaces of the mount members 222, 224 may abut against one another within the cavity formed by the joined left and right inner cavities 226, 228).

In some embodiments, the cross sections of the respective entrances 230, 234 to each inner cavity 226, 228 correspond to the cross section of the portions of the wing members 210, 212 that extend outward from the left and right sides L, R of the fuselage body 102. In addition, the cross section of the inner portion of each inner cavity 226, 228 corresponds to the cross section of the mounting members 222, 224.

As shown, the width W1 of the left wing member 210 (which equals the width of the entrance to the left inner cavity 226) is smaller than the width W2 of the left mounting member 222 (which equals the width of the left inner cavity 226).

As shown, the height H1 of the entrance to the left inner cavity 226 (which equals the height of the left wing member 210 as shown in FIG. 10) is smaller than the height H2 of the inner portion of the left inner cavity 226 (which equals the height of the left mounting member 222).

Given the above, once inserted into the left inner cavity 226, the left mounting member 224 may not pass outward through the entrance of the cavity 226 due to its greater width W2 and height H2, and the left wing member 210 is thereby coupled to the fuselage body 102.

The above description regarding the left wing member 210, the left mounting member 222, and the left inner cavity 226 also applies to the right wing member 212, the right mounting member 224, and the right inner cavity 228, thereby coupling the right wing member 212 with the fuselage body 102. Accordingly, to avoid duplicative descriptions, this will not be described in further detail.

Notably, as shown in FIG. 9, in some embodiments, the cavity entrances 230, 234 are generally parallel to the horizontal, such that the wing members 210, 212 also are generally parallel to the horizontal (as shown in FIG. 10) and the dihedral angle of the wing member 210, 212 is generally zero.

While the mounting members 222, 224 and the corresponding inner cavities 226, 228 are shown in FIG. 8 as oval disks (oval disk-shaped prisms), and in FIGS. 9-10 as side sections of a cylinder, it is understood that the mounting members 222, 224 and corresponding inner cavities 226, 228 may be formed as any shape or form with any dimensions as necessary to ensure that the mounting members 222, 224 provide an adequate mounting base for each respective wing member 210, 212. For example, the members 222, 224 and cavities 226, 228 may be formed as cuboids, rectangular prisms, triangular prisms, trapezoidal prisms, spheres, oblong spheres, cylinders and/or sections thereof, cones, half spheres, pyramids, hexagonal prisms, other shaped prisms and/or sections thereof, other suitable shapes, and/or any combinations thereof.

Figure 11:
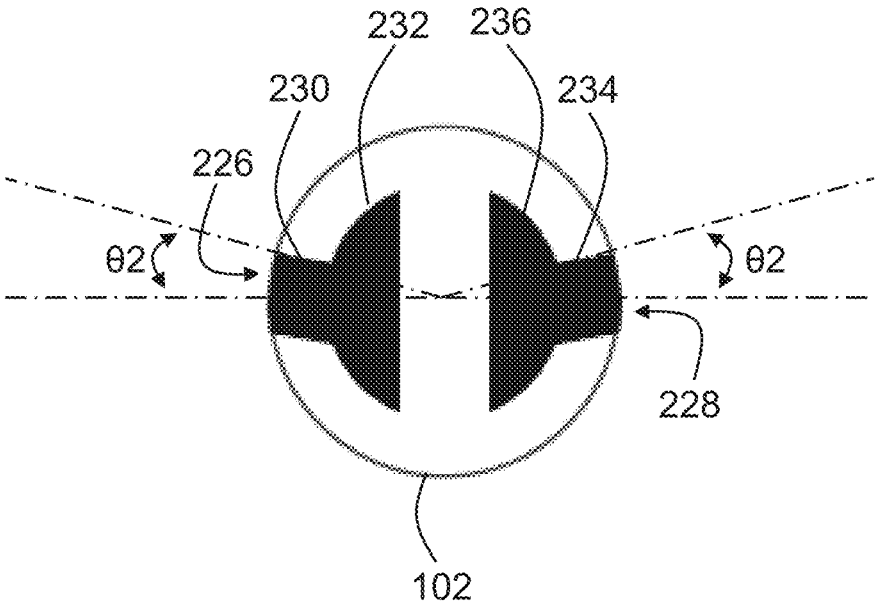
FIG. 11 shows aspects of an attachment mechanism according to exemplary embodiments hereof.
Figure 12:
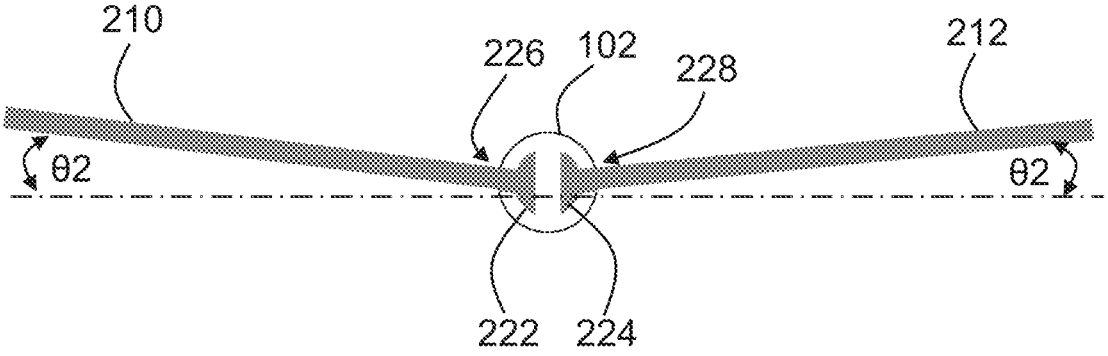
FIG. 12 shows aspects of an attachment mechanism and associated wing members according to exemplary embodiments hereof.

In some embodiments, as shown in FIGS. 11-12, the respective entrances 230, 234 to the left and right inner cavities 226, 228 are upwardly inclined with respect to the horizontal axis X2. For example, the left and right cavity entrances 230, 234 are each upwardly inclined at an angle θ2 with respect to the X2 axis on opposite sides. Accordingly, as shown in FIG. 12, the left and right wing members 210, 212 also may be inclined at a dihedral angle θ2 with respect to the X2 axis.

Figure 13:
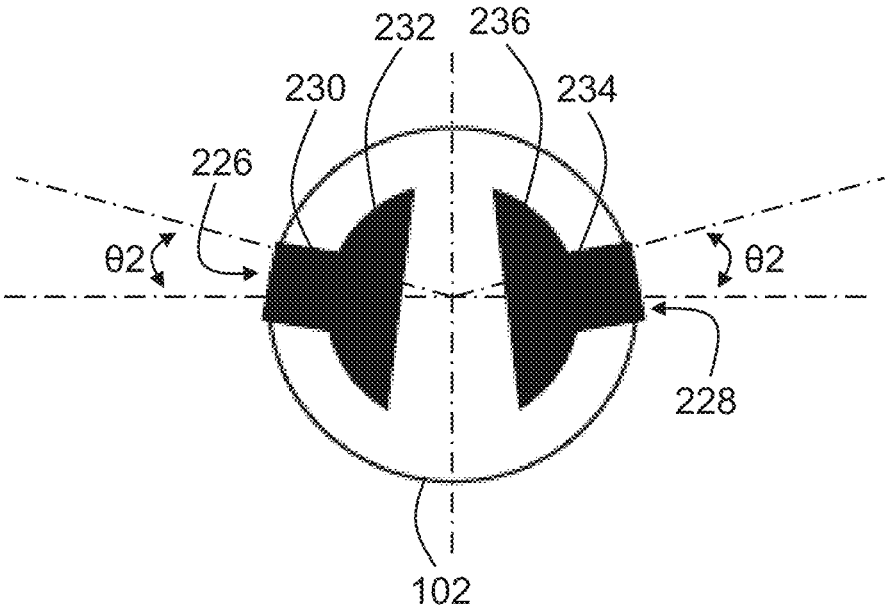
FIG. 13 shows aspects of an attachment mechanism according to exemplary embodiments hereof.

FIG. 13 shows another embodiment of the cross section of the fuselage body 102 as described above taken from the perspective of the cutlines B-B of FIG. 8 (sans the wing members 210, 212 for added clarity). In this embodiment, the inner most walls of the left and right inner cavities 226, 228 are inclined towards the vertical to provide the desired dihedral angles θ2 of the wing members 210, 212. It is understood that the left and/or right inner cavities 226, 228 may include any forms at any angles of inclination in order to provide the required amount of support to the mounting members 222, 224 and the corresponding wing members 210, 212.

Figure 14:
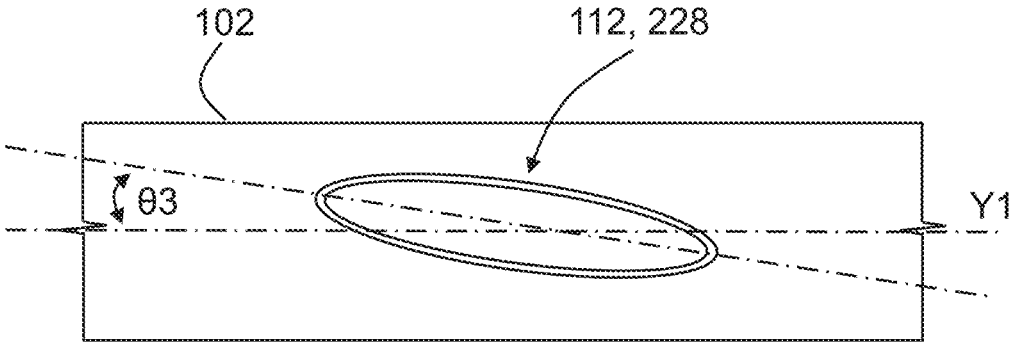
FIG. 14 show aspects of aspects of an attachment mechanism according to exemplary embodiments hereof.

FIG. 14 shows a the through-slot 112 and/or the entrance 234 of the right inner cavity 228 taken from the perspective of looking at the fuselage body 102 from the right R in FIG. 4 and/or FIG. 8, respectively. In some embodiments, as shown in FIG. 14, the through-slot 112 and/or the entrance 234 of the right inner cavity 228 is angled upward (e.g., inclined from right to left) thereby providing a desired upward angle 83 to a single-piece wing member 202 passing therethrough and/or to a right wing member 212 secured therein. In some embodiments, the upward angle θ3 is chosen to be the desired angle of incidence for the wing 202 and/or wing member 212. It is understood that for multi-piece wing member 208, the entrance 230 to the left inner cavity 226 also may be inclined at the same angle θ3 to provide the desired angle of incidence to the left wing member 210.

It is understood that a single-piece wing member 202 also may include one, both, and/or a combination of mounting members 222, 224 at its portion that may pass through the through-slot 112 to provide added support to the wing member 202 and to help in holding it in place within the slot 112. It also is understood that the through-slot 112 may include one, both, and/or a combination of inner cavities 226, 228 to receive and secure the one or both mounting members 222, 224, respectively.

Figure 10A:
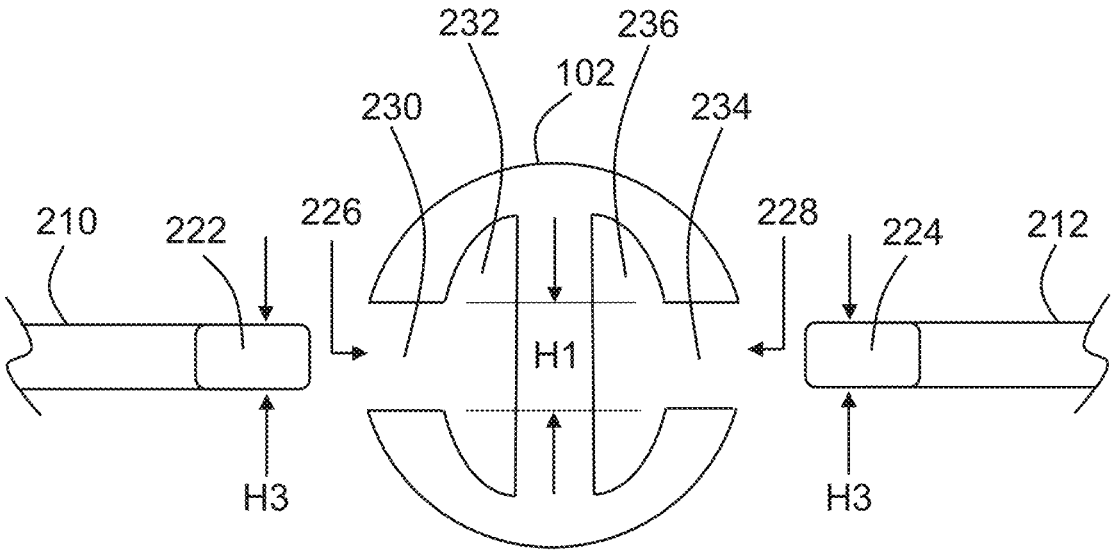

In use, to configure the wing members 210, 212 to the fuselage body 102, the wing members 210, 212, including the associated mounting members 222, 224, are deflated. This results in the mounting members 222, 224 becoming deflated mounting members with reduced cross section areas. For example, as shown in FIG. 10A, the deflated mounting members each include a reduced height H3 that is less than the height H1 of the cavity entrances 230, 234 of the respective cavities 226, 228. The deflated mounting member 222 is then inserted into the associated inner cavity 226, and the deflated mounting member 224 is inserted into the associated inner cavity 228. The wing members 210, 212 are arranged as desired, and subsequently inflated (along with the associated mounting members 222, 224). As the mounting members 222, 224 inflate, the members 222, 224 expand to fill the corresponding inner cavities 226, 228, thereby coupling the members 222, 224 with the cavities 226, 228, and the wing members 210, 212 to the fuselage body 102.

To remove the wing members 210, 212 from the fuselage body 102, the wing members 210, 212, including the associated mounting members 222, 224, are deflated thereby allowing the mounting members 222, 224 to be removed from the inner cavities 226, 228, and the wing members 210, 212 from the fuselage body 102.

This procedure also may be generally followed to configure the single-piece wing member 202 within the through-slot 112 (that is, inserted through the through-slot 112 in a deflated state, aligned therein as desired, and then subsequently inflated).

In other embodiments, the first and second mounting members 222, 224 may be secured within the first and second attachment mechanism 112-1, 112-2 via pressure fit, detents, notches, latches, clips, other types of attachment mechanisms, and any combinations thereof.

Figure 15:
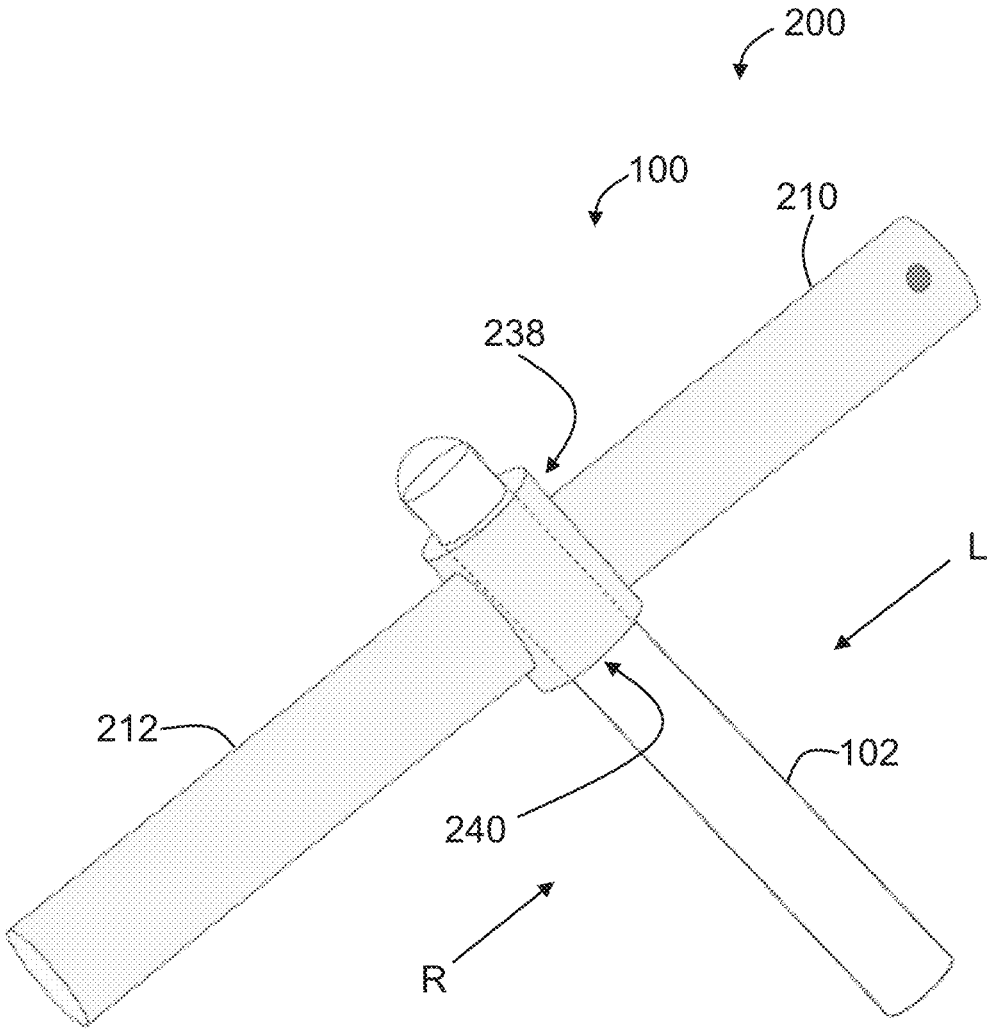
FIG. 15 show aspects of aspects of an attachment mechanism according to exemplary embodiments hereof.

In some embodiments, as shown in FIG. 15, the wing attachment mechanism 108 includes an outer sheath 238 designed to encircle at least a portion of the fuselage body's outer circumference in the area where the left and right wing members 210, 212 are to be configured. The sheath 238 includes a through-hole 240 passing from its front end to its rear end through which the fuselage body 102 is received and secured.

In some embodiments, the sheath 238 is inflatable and/or deflatable. When in its deflated state, the through-hole 240 includes a diameter that is equal to or slightly larger than the diameter of the fuselage body 102 (in the area where the body 102 passes through the through-hole 240), and when in its inflated state, the diameter of the through-hole 240 is preferably slightly smaller than the diameter of the fuselage body 102 in this area. In this way, the fuselage body 102 may be inserted through the through-hole 240 and properly positioned when the sheath 238 is deflated, and subsequently, when the sheath 238 is then inflated, the through-hole 240 may tighten around the outer circumference of the fuselage body 102 thereby holding it snug and secure.

In some embodiments, the fuselage body 102 may include notches and/or other surface elements/textures about its outer circumference that may hold the body 102 in place within the sheath's through-hole 240 when the sheath 238 is inflated. In other embodiments, the inner circumference of the sheath 238 may include notches and/or other surface elements/textures that may hold the sheath 238 in place about the fuselage body 102 when the sheath 238 is inflated. In some embodiments, the surface notches/textures on the outer circumference of the fuselage body 102 may correlate with the surface notches/textures on the sheath's inner circumference thereby locking the sheath 238 in place about the fuselage body 102.

While the sheath 238 shown in FIG. 15 is depicted as generally tubular, it is understood that the sheath 238 may include any suitable shape or form to fulfill its functionalities.

The wing assembly 200 also may include other types of wings such as, without limitation, mono, multi-bi/tri, closed, canards, other types of wings and any combinations thereof.

The inflatable architecture of the wing assembly 200 will be described in other sections.

Empennage Assembly 300

Figure 16:
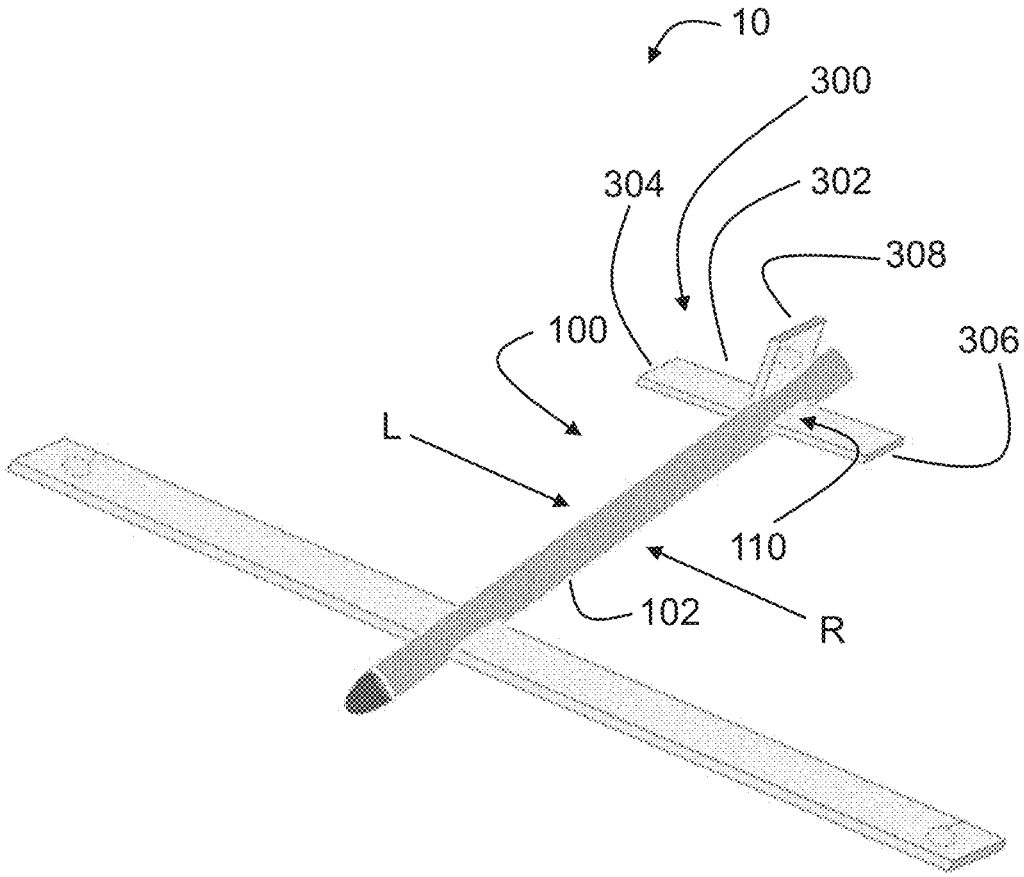
FIG. 16 shows an empennage assembly according to exemplary embodiments hereof.

In some embodiments, as shown in FIG. 16, the empennage assembly 300 includes an inflatable horizontal stabilizer 302 including a first end 304 (e.g., the left end in FIG. 13), and a second end 306 (e.g., the right end in FIG. 13). The stabilizer 302 may include a single-piece stabilizer or a multi-piece stabilizer. The details of the wing assembly 200 as described herein also pertain to the empennage assembly 300 with respect to the structures of the empennage assembly 300, and as such, to avoid duplicative descriptions, this will not be described in further detail.

In some embodiments, as shown in FIG. 16, the fuselage assembly 100 includes an empennage attachment mechanism 110 adapted to attach the empennage assembly 300 to the fuselage body 102. The details of the wing attachment mechanism 108 as described herein also pertain to the empennage attachment mechanism 110 with respect to how the empennage assembly 300 may be configured with and attached to the fuselage body 102 towards the tail 106. Accordingly, to avoid duplicative descriptions, this will not be described in further detail.

In some embodiments, as shown in FIG. 16, the empennage assembly 300 also includes an inflatable vertical stabilizer 308 adapted to be attached to the top of the fuselage body 102 using any of the techniques described with respect to attaching the single-piece wing member 202 and/or the multi-piece wing member 208 to the fuselage body 102.

Empennage assemblies 300 using other types of tail and fin configurations also are contemplated, such as, without limitation, twin tails/booms, Y tails, V tails, X tails, tailless, other types of tail configurations, and any combinations thereof.

The inflatable architecture of the empennage assembly 300 will be described in other sections.

Inflatable Architecture of the Inflatable Elements

In some embodiments as shown in FIGS. 17A-17D, the wing assembly 200 and/or the empennage assembly 300 each include one or more inflatable bodies B with a inner volumes V, and at least one valve mechanism 400 adapted to facilitate the inflation and subsequent deflation of the body B as desired. The valve mechanism 400 may include a pneumatic valve as is known in the art. It is preferable that the valve mechanism 400 be attachable to an air supply receptacle (e.g., the end of an air hose or air pump), and/or allow the body B to be inflated manually (e.g., by mouth).

Figure 17A:
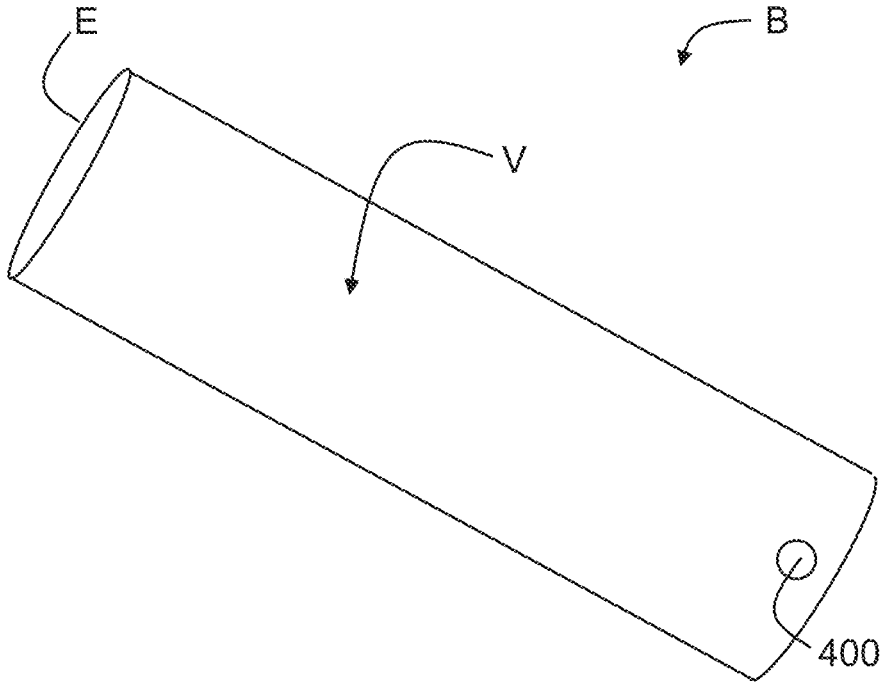
FIGS. 17A-17D show inflatable bodies according to exemplary embodiments hereof.

In some embodiments as shown in FIG. 17A, the inflatable body B includes a single inflatable element E and a single inner volume V.

Figure 17B:
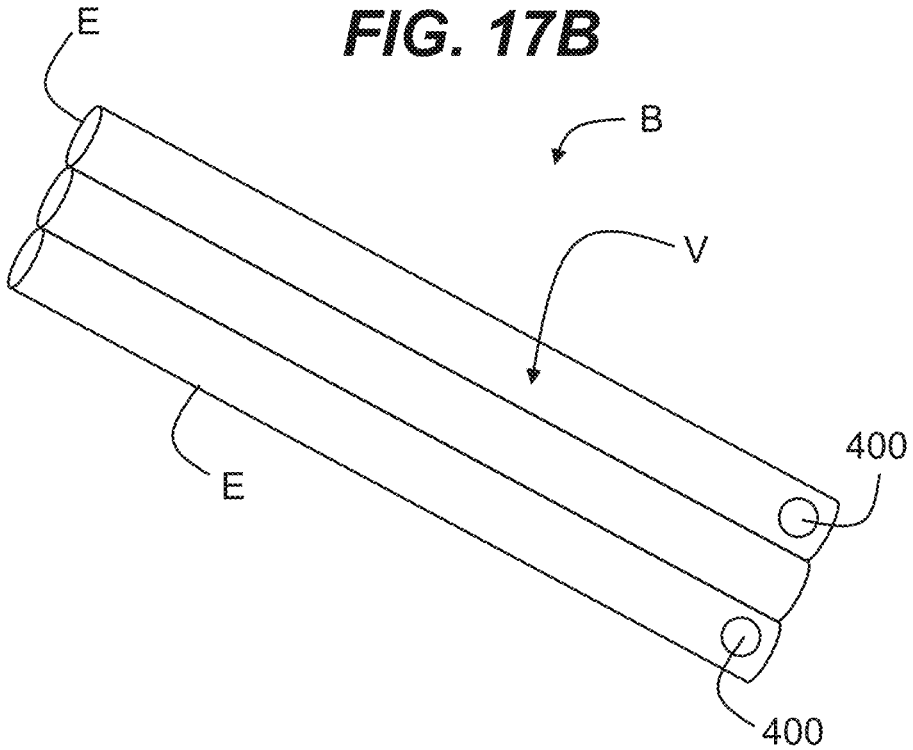

In some embodiments as shown in FIG. 17B, the inflatable body B includes a plurality of inflatable elements E (e.g., channels) aligned and connected to one another longitudinally that together form the overall body B and inner volume V. In some embodiments, the elements E communicate internally with one another so that a single inner volume V is formed. In this way, a single valve mechanism 400 may be employed to inflate the inner volume V. In other embodiments, the elements E may include individual inner volumes V, each including a dedicated valve mechanism 400.

Figure 17C:
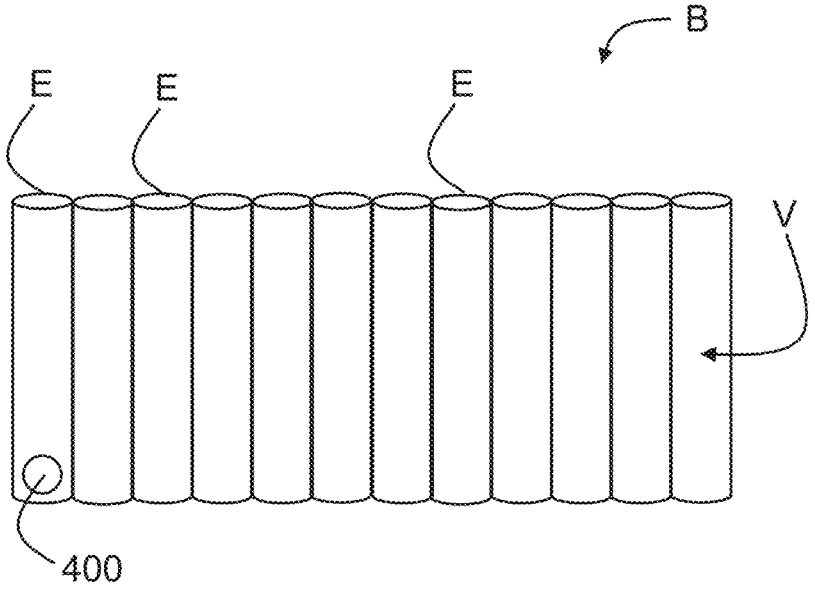

In some embodiments as shown in FIG. 17C, the inflatable body B includes a plurality of inflatable elements E (e.g., channels) aligned and connected to one another laterally that together form the overall body B and inner volume V. In some embodiments, the elements E communicate internally with one another so that a single inner volume V is formed. In this way, a single valve mechanism 400 may be employed to inflate the inner volume V. In other embodiments, the elements E may include individual inner volumes V, each including a dedicated valve mechanism 400.

Figure 17D:
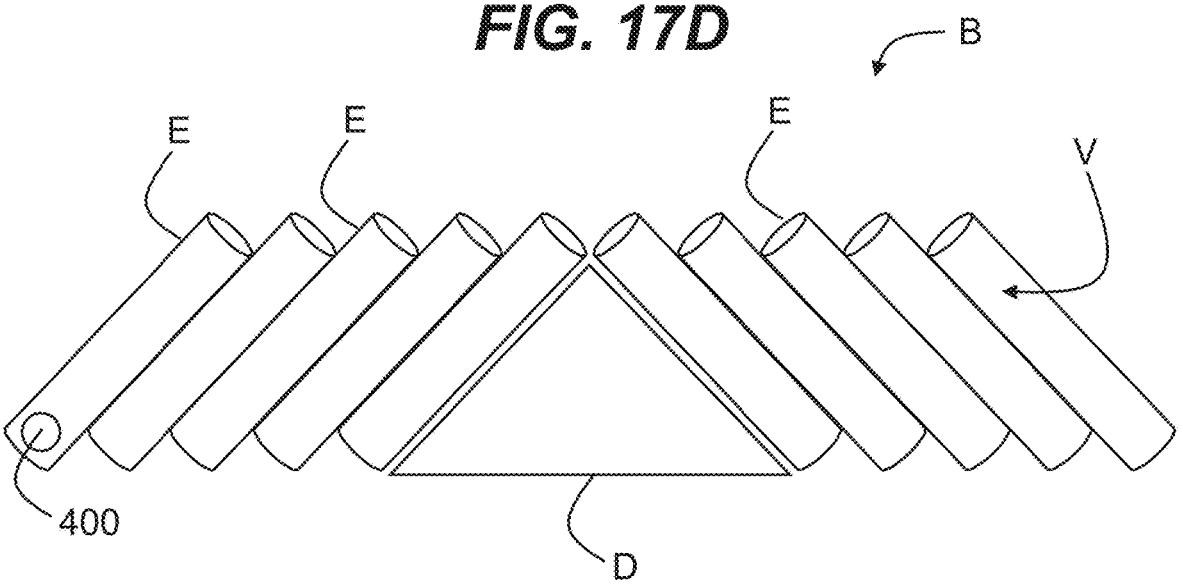

In some embodiments as shown in FIG. 17D, the inflatable body B includes a plurality of inflatable elements E (e.g., channels) oriented at offset angles and connected to one another to form the overall body B and inner volume V. In some embodiments, the elements E communicate internally with one another so that a single inner volume V is formed. In this way, a single valve mechanism 400 may be employed to inflate the inner volume V. In other embodiments, the elements E may include individual inner volumes V, each including a dedicated valve mechanism 400. Note that in this embodiment, the inflatable body B also may include a central base D adapted to join one or more pluralities of inflatable elements E together. The central base D may or may not be inflatable.

While the inflatable elements E shown in FIGS. 17A-17D are depicted as the same or similar in size and shape, it is understood that elements E may each be of any shape and/or size and that the elements need not match. It also is understood that elements E may be arranged in any way and in any position with respect to one another. It is further understood that the examples provided in FIGS. 17A-17D are meant for demonstration and that the inflatable body B may include any number of inflatable elements C of any shape, form, size, position, location, and/or orientation, and that the scope of the plane assembly 10 is not limited in any way by the shape, form, size, position, location, and/or orientation of the elements C.

In some embodiments, the fuselage assembly 100 also is inflatable and may include an inflatable body B including any arrangement of inflatable elements E and valve mechanisms V as described herein.

In some embodiments, the inflatable bodies B (e.g., of the fuselage assembly 100, of the wing assembly 200, and/or of the empennage assembly 300) include support elements (e.g., rods, beams, dowels, plates, brackets, spars, ribs, stringers, etc.) that may provide additional support to the assemblies 100, 200, 300.

In some embodiments the fuselage assembly 100, the wing assembly 200, and/or the empennage assembly 300 configured with a first inflatable plane assembly 10 may be interchanged with a different fuselage assembly 100, wing assembly 200, and/or empennage assembly 300 to form a different inflatable plane assembly 10.

In some embodiments, the fuselage assembly 100, the wing assembly 200, and/or the empennage assembly 300 may be formed as characters such as superheroes or fairies, or fantastical creatures such as dragons or unicorns or other items with inflatable and membrane portions. The inflatable plane assemblies 10 also may be branded to provide marketing opportunities for companies, organizations, schools, colleges, sports teams, cities, airports, and other entities.

It is understood that any aspect and/or element of any embodiment of the assembly 10 described herein or otherwise may be combined in any way with any other aspect and/or element of any other embodiment to form additional embodiments of the assembly 10 all of which are within the scope of the assembly 10.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

The invention claimed is:

1. An inflatable toy airplane comprising:

a fuselage body including an inner volume and a first at least one cavity within the inner volume, the first at least one cavity including a first at least one cavity entrance extending from outside the fuselage body to the first at least one cavity;

a first inflatable wing member adapted to be releasably attached to the fuselage body and including a first wing proximal end and a first wing distal end, the first wing proximal end including a first mount adapted to be received into the first at least one cavity, the first mount including a first cross section with a first cross section size, the first cross section size increasable from a first deflated cross section size when the first mount is deflated to a first inflated cross section size when the first mount is inflated, the first deflated cross section size less than a cross section of the first at least one cavity entrance and the first inflated cross section size greater than the cross section of the first at least one cavity entrance.

2. The inflatable toy airplane of claim 1 wherein the fuselage body is inflatable.

3. The inflatable toy of claim 1 further comprising at least one valve mechanism adapted to inflate and/or deflate the inflatable toy airplane.

4. The inflatable toy airplane of claim 1 further comprising a second inflatable wing member adapted to be releasably attached to the fuselage body and including a second wing proximal end and a second wing distal end, the second wing proximal end including a second mount;

wherein the fuselage body includes a second at least one cavity within the inner volume, the second at least one cavity including a second at least one cavity entrance extending from outside the fuselage body to the second at least one cavity;

wherein the second mount is adapted to be received into the second at least one cavity, the second mount including a second cross section with a second cross section size, the second cross section size increasable from a second deflated cross section size when the second mount is deflated to a second inflated cross section size when the second mount is inflated, the second deflated cross section size less than a cross section of the second at least one cavity entrance and the second inflated cross section size greater than the cross section of the second at least one cavity entrance.

5. The inflatable toy airplane of claim 4 wherein the fuselage body includes a front end and a rear end defining a first longitudinal axis, and the second at least one cavity entrance is oriented at the offset angle with respect to the longitudinal axis.

6. The inflatable toy airplane of claim 4 wherein the fuselage body includes a left side and a right side defining a second longitudinal axis, and the second at least one cavity entrance is oriented at an offset angle with respect to the second longitudinal axis.

7. The inflatable toy airplane of claim 1 wherein the fuselage body includes a front end and a rear end defining a first longitudinal axis, and the first at least one cavity entrance is oriented at an offset angle with respect to the first longitudinal axis.

8. The inflatable toy airplane of claim 1 wherein the fuselage body includes a left side and a right side defining a second longitudinal axis, and the first at least one cavity entrance is oriented at an offset angle with respect to the second longitudinal axis.

9. An inflatable toy aircraft comprising:

an aircraft body including an inner volume and a first at least one cavity within the inner volume, the first at least one cavity including a first at least one cavity entrance extending from outside the aircraft body to the first at least one cavity;

a first inflatable wing member adapted to be releasably attached to the aircraft body and including a first wing proximal end and a first wing distal end, the first wing proximal end including a first mount adapted to be received into the first at least one cavity, the first mount including a first cross section with a first cross section size, the first cross section size increasable from a first deflated cross section size when the first mount is deflated to a first inflated cross section size when the first mount is inflated, the first deflated cross section size less than a cross section of the first at least one cavity entrance and the first inflated cross section size greater than the cross section of the first at least one cavity entrance.

10. The inflatable toy aircraft of claim 9 further comprising a second inflatable wing member adapted to be releasably attached to the aircraft body and including a second wing proximal end and a second wing distal end, the second wing proximal end including a second mount;

wherein the aircraft body includes a second at least one cavity within the inner volume, the second at least one cavity including a second at least one cavity entrance extending from outside the aircraft body to the second at least one cavity;

wherein the second mount is adapted to be received into the second at least one cavity, the second mount including a second cross section with a second cross section size, the second cross section size increasable from a second deflated cross section size when the second mount is deflated to a second inflated cross section size when the second mount is inflated, the second deflated cross section size less than a cross section of the second at least one cavity entrance and the second inflated cross section size greater than the cross section of the second at least one cavity entrance.

* * * * *